United States Patent [19]

Stern et al.

[11] Patent Number: 4,962,759

[45] Date of Patent: Oct. 16, 1990

[54] AIR BUBBLING MATS HAVING HEATED AIR FOR THERAPEUTICALLY AGITATING BATH WATER

[75] Inventors: Richard J. Stern, Chicago; Donald J. Kempiak, Palatine, both of Ill.

[73] Assignee: Associated Mills Inc., Chicago, Ill.

[21] Appl. No.: 153,146

[22] Filed: Feb. 8, 1988

[51] Int. Cl.[5] ..... A61H 9/00

[52] U.S. Cl. ..... 128/66; 4/543; 4/544; 392/362

[58] Field of Search ..... 128/64–66, 128/DIG. 10, 400; 4/541–545; 219/362, 364, 366, 369, 370, 371, 374, 375; 137/846; 417/566

[56] References Cited

U.S. PATENT DOCUMENTS

| | | | |
|---|---|---|---|
| 1,699,198 | 1/1929 | Millmather | 128/66 |
| 2,689,906 | 9/1954 | Corbett | 219/366 |
| 3,461,862 | 8/1969 | Kemper | 128/66 |
| 4,325,149 | 4/1982 | Moreland | 4/542 |
| 4,739,153 | 4/1988 | Rendel | 219/366 |

*Primary Examiner*—Edgar S. Burr
*Assistant Examiner*—Huong Q. Pham
*Attorney, Agent, or Firm*—Laff, Whitesel, Conte & Saret

[57] ABSTRACT

A bubbling air mat has an air hose leading to a control unit having a motor therein. A number of saftey devices are provided to prevent a user from being electrocuted if water reaches the control unit. In the most protected area within the control unit, a rope heater is provided to warm an air stream being driven by said motor and through said air hose to bubble from the air mat.

5 Claims, 2 Drawing Sheets

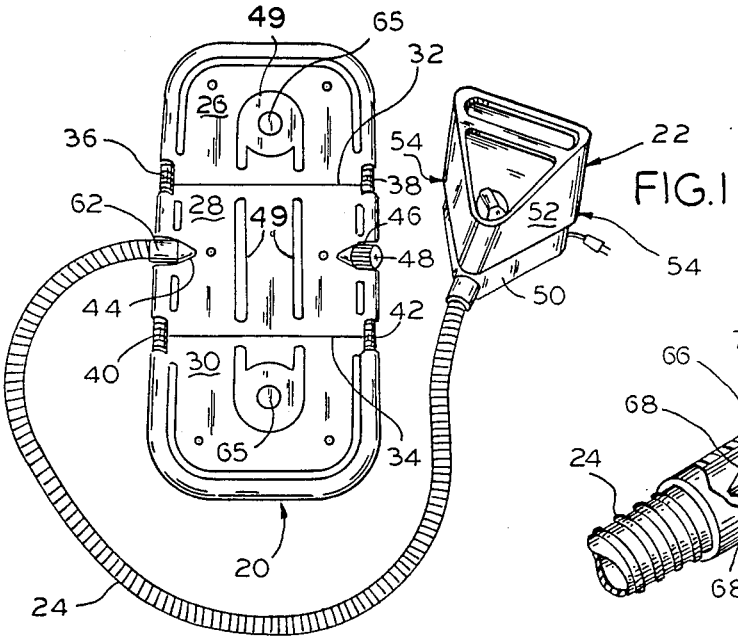
FIG.1
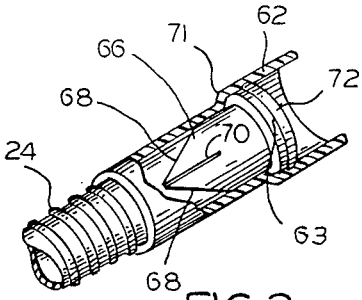
FIG.2
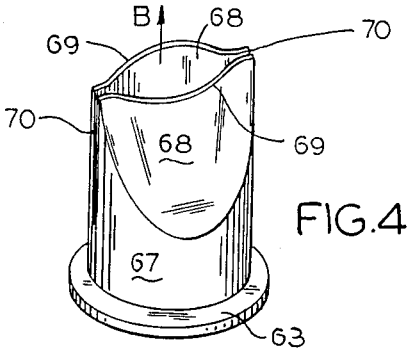
FIG.4
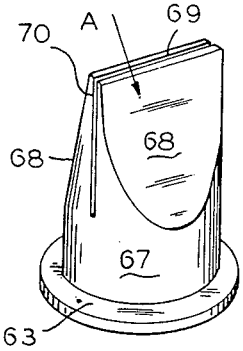
FIG.3
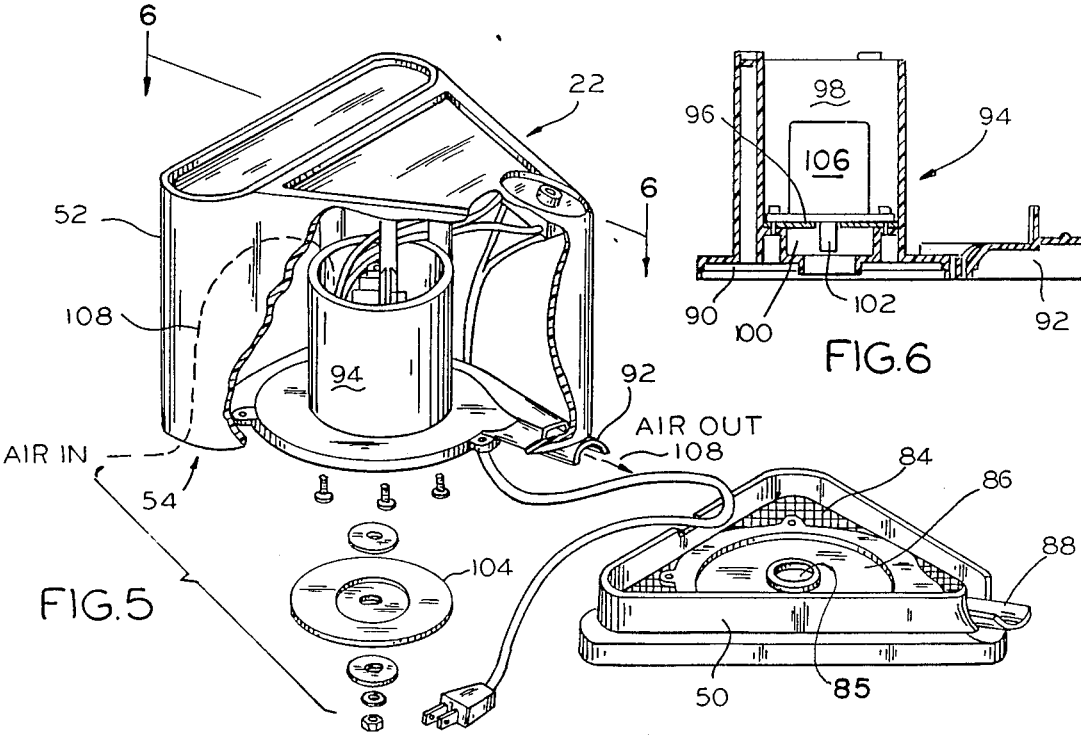
FIG.5
FIG.6

AIR BUBBLING MATS HAVING HEATED AIR FOR THERAPEUTICALLY AGITATING BATH WATER

This is a continuation-in-part of Ser. No. 07/067,490, filed June 26, 1987.

This invention relates to air bubbling bath mats and more particularly to mats for therapeutically distributing and agitating heated air throughout the water of a bath.

One example of air bubbling mats of the described type is found in U.S. Pat. No. 4,417,568. Other U.S. patents showing the state of the art are U.S. Pat. Nos. 4,290,982; 4,269,797; 4,122,846; 4,040,415; 4,008,498; 3,809,073; 3,111,686; 1,775,942; 1,699,198; and 1,350,974. A German Pat. No. 827,391 also shows the state of the art.

Co-pending application Ser. No. 07/067,490, filed June 26, 1987, shows a similar mat without heat. This air mat has overcome a number of drawbacks, which have been encountered in prior air bubbling mats. A first of these drawbacks relates to the safety of the device. The air bubbling mat is used under water, as in a bath tub, for example, and is associated with an electrical air pump for pressurizing air to create the bubbles. As with all appliances used around water, there is a problem of shock and possibly of electrocution. The problem is made worse since the user may fail to follow instruction. For example, if he picks up the pad while it is full of water, it may run back through an air hose, into an electrical motor, and make contact with some hot wires. If the user or someone else walks into or trips over an air hose or an electrical cord, he may pull the air pump so that it could fall into the water or tip over to energize a puddle on the floor.

Another problem relates to the utility of check valves that might be used to prevent a back flow of water through the air hose and into the air pumping device. Those check valves have tended to be expensive, precision devices, which may stick, become limed, or otherwise fail, especially after long years of use. Also the fit or form of such a check valve is such that it may not operate reliably if there has been a physical abuse of the device, such as might occur if a user does not exercise due care.

The co-pending application solves these problems; however, it blows room temperature air through the mat. Even if a person is sitting in warm water, the relatively cold air will cool the water and may be uncomfortable. Either of which will lead to an uncomfortable situation.

When pressurized air is supplied from an electric air pump to a bath mat submerged in water occupied by a human, it is necessary to provide for all of the foregoing considerations, such as safety from back drainage, electrocution, comfort convenience, and the like. It tends to become very expensive to provide all of these features for the mat, and yet such a device cannot become too expensive and still remain competitive in the marketplace. The addition of heat to the air stream increases the cost problems.

Accordingly, an object of the invention is to provide new and improved air bubbling bath mats with heated air. Here, an object is to provide bath mats having safety devices built into them, such as check valves to prevent a back flow of water, and air pumps which are less likely to tip over or fall into a tub. A further object is to add a heating element to such a mat at practically no cost and without introducing any safety hazard which did not previously exist.

In keeping with an aspect of this invention, these and other objects are accomplished by a rigid molded pad including a plurality of air holes through which air is emitted. The pressurized air is fed into the mat from a control unit including a motor. The pressurized air hose includes a duck-bill check valve to prevent any back flow of water into the air pump. The motor is vertical in an elevated location within the air pump, where it is protected so that it is less likely to tip over and possibly fall into the bath. The heater is a simple and low cost device that snaps over the top motor at the most protected point so that all of the safety devices which are built into the air pump are reused to protect the heater. Thus, the only cost added by the heater is the relatively low cost of the heating device, itself.

A preferred embodiment of the invention is shown in the attached drawing, wherein:

FIG. 1 is a pictorial view of the invention comprising an air bubbling bath mat, an air line hose, and an air pump;

FIG. 2 is a fragmentary view of the air hose showing the location of a duck-bill check valve within the air line hose;

FIG. 3 is a perspective view of the duck-bill check valve in a closed position;

FIG. 4 is a similar perspective view of the duck-bill check valve in an open position;

FIG. 5 is an exploded view, in perspective, of the air pump;

FIG. 6 is a cross section taken along line 6—6 of FIG. 5 showing a bulk head and spill way for isolating any back flow of water from the electric pump;

Figure 7:
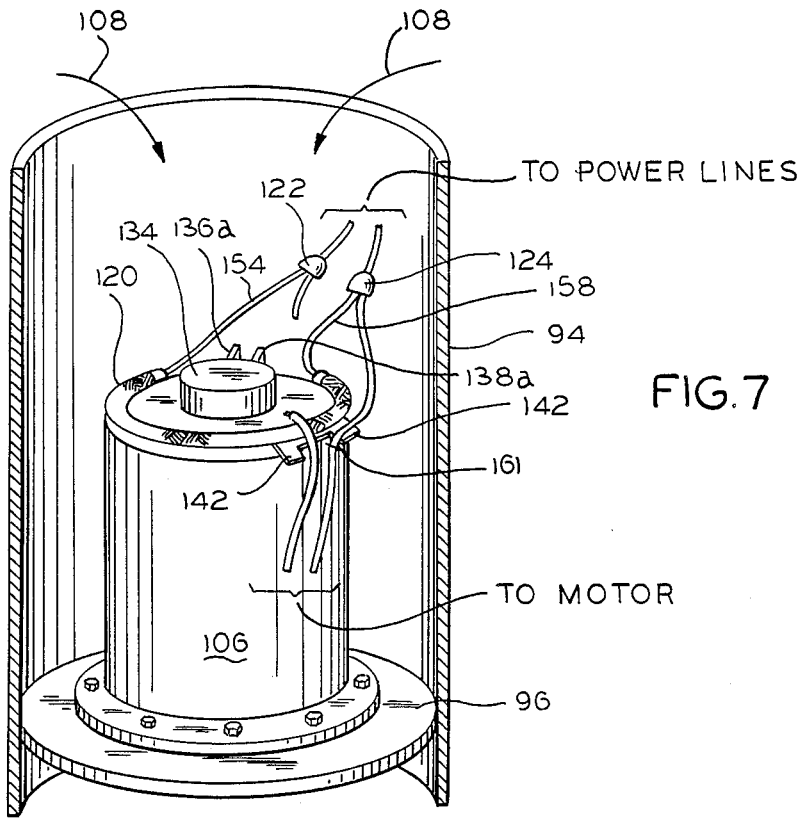
FIG. 7 is a perspective view, partly in cross section, of the heater, the motor, and its housing.

In FIG. 1, an air mat 20 is connected to an air pump 22 via an air line hose 24. The air mat may be made in three sections 26, 28, 30. While any suitable method may be used to manufacture the mat sections 26, 28, 30, it is thought that blow molding will be preferred in most cases. The three sections 26, 28, 30 are joined together in any suitable manner, as indicated by the lines 32, 34 in FIG. 1. For passage of pressurized air between the three sections 26, 28, 30 short sections of convoluted hose 36, 38, 40, 42 or other suitable conduits are connected across the hinged areas.

Two ports 44, 46 are centrally formed on opposite edges of the center section 28. Either one of these ports may be used as an input port to connect the air line hose 24, which may be convoluted for strength and flexibility. Preferably, the hose is inserted into port 46 and then given a half turn. The opposite port 46 is normally closed with cap 48. If it is desirable to use an appliance in connection with the air bubbling mat, this cap 48 is removed and an output air line hose leading to the appliance is attached to the output port 46.

The areas enclosed by line 49 indicates patterns where air holes are provided from which air may bubble. In the end sections, the patterns are two concentric U-shapes. The open ends of the U's point toward the center section. In the center section, the pattern is one of spaced parallel lines which complete two concentric somewhat oval patterns of air holes. Air holes may also be formed at 65, 65 to provide a sitz bath.

It should be apparent that, when air is introduced at a central location, such as 44, 46, the distance to the most remote air hole is half the distance that would be if the air is introduced at an end of the air bubbling mat 20. Thus, with the central connection, there is a better distribution of the pressurized air. Even if a person sits on the mat, shifts his weight, moves around, etc, the better distribution of air given by the center entrance will tend to keep a more uniform flow of air.

The air pump 22 (FIG. 1) is coupled to the distant end of the air line hose 24 at a relatively low point on the air pump housing. Thus, there is a much less chance of tipping or overturning the pump 22 if the hose 24 is pulled.

The base 50 of the housing is recessed slightly relative to the top 52 of the housing to provide elevated air intake ports 54. Therefore, if the air pump 22 is setting on a deep pile rug, towel, or the like, it will not be sucked against the air intake port, as may happen when the air intake is in the bottom of base 50.

To preclude a back flow of water, a duck-bill check valve 66 (FIG. 2) is placed within the air line hose 24, preferably at an end fitting 62. This check valve 66 (FIGS. 3, 4) is made of a soft elastomer, such as natural rubber (about 35–40 durometer). In greater detail, a generally cylindrical tubular section 67 rises from an outwardly projecting flange 63, which serves as an anchor point. The top of the cylindrical section 67 has a bevelled roof 68, 68 leading to a slit 69 extending across the top and along the apex of the bevel 68, 68 and continuing for a distance 70 which is more than 50% of the cylinder length down each side of the cylinder. The flange 63 fits into the end fitting 62 (FIG. 2) and rests against a step 71 molded therein. A retainer ring 72 snaps into the end fitting 62 to hold the flange and, therefore, the duck-bill check valve in place.

The operation of the duck-bill check valve is best seen in FIGS. 3, 4. More particularly, if any water flows back through the air line hose 24, it impinges upon the bevelled roof surfaces 68, 68, as indicated by the arrow A (FIG. 3). The resulting pressure forces the slits 69, 70 into a closed position. Therefore, little, if any, water can pass through the slit. On the other hand, air can pass freely through the slit in the direction B (FIG. 4) responsive solely to the air pressure within the hose. Thus, there is only a one-way flow of fluid (air or water) through the air line hose 24.

The air pump construction is best seen in FIGS. 5, 6, as having two principal parts, base 50, housing 52. The bottom panel of base 50 has an open grille work 84 and a cage at 85 through which any water which back flows through the duck-bill check valve may pass. Of course, there should be no such water; therefore, this is a safety feature. The space within the base 50, which is beneath the grille work 84 is filled with a sound deadening, but completely porous, sponge-like material. A circular depression 86 provides one half of an impeller housing leading to the air discharge port 88 to which the air line hose 24 connects. The opposite and complementary sides of the impeller housing 90 (FIG. 6) and air discharge port 92 are in a lower plate of motor support housing 94.

The motor support housing 94 includes a bulkhead 96 which separates a motor containing section 98 from a water collection compartment 100. Thus, in the very unlikely event that water passes through the duck-bill check valve 66, it reaches and tends to collect in the water collection compartment 100 and is not supposed to rise into the motor section 98. A spill way 102 is positioned in the wall of housing 94 to empty the water in compartment 100, hopefully as fast as it collects. The volume of compartment 100 and the area of spill way 102 are large enough to contain and remove all water before it can rise too far, if at all, into the motor section 98 under even the worst case where the entire air line hose 24 and air bubbling mat 20 is full of water and duck-bill check valve 66 fails completely or is inadvertently omitted or removed. The water passing through spill way 102 leaks out and exits base 50 through grille 84 or cage 85 (FIG. 5).

The motor 106 rotates impeller 104 to drive air through intake opening 54, air passage 108, motor support housing 94, the impeller housing 86–90, out the port 88-92 to air line hose 24 (FIG. 1), and on to the air bubbling mat 20. This air stream 108 both cools the motor and is warmed by any heat generated within the motor. The motor may be given three speeds by providing two windings and a diode which may be switched into the energizing circuit to eliminate half cycles of one polarity.

According to the invention, a heating element 120 (FIGS. 7, 8) is snapped on over the motor 106 to heat the air stream 108. The heating element 120 is preferably connected in parallel with the motor at connectors 122, 124 so that the heat is switched on whenever the motor is running. However, it is also within the scope of the invention to switch the motor and the heater by separate switches, so that operation of the heater is optional.

The heater element is preferably made from flexible fiberglass (often referred to as a "rope heater" because it has great flexibility). This heater is fabricated by helically wrapping resistance wire around a core material. The resulting cordage is then covered with one or two walls of braided fiberglass. By controlling the diameter of the core, the resistance wire choice and pattern, and the wall thickness of the braided insulation, heating element 120 can be provided with watt densities up to 12 watts per lineal inch of heater. The maximum operating temperature of these elements will be about 850° F.

An important aspect of a rope heater is that it has an extremely small thermal inertia. Therefore, it gives almost instant heat. Flexible fiberglass rope heaters are typically found in countertop appliances—coffee brewers, slow cookers, buffet warmers—as well as many industrial and commercial applications where long life, low cost, flexible heating is required. Because of the woven nature of fiberglass sleeving, flexible fiberglass rope heaters are not usually an appropriate choice for moist or wet applications.

The particular rope heater which was used in one embodiment of the invention was supplied by Aitken-Reed Inc., 2902 Lindbergh Drive, Manitowoc, Wis. 54220. To help ensure longer life, this rope heater was fabricated by helically wrapping 0.008" diameter "D" grade resistance wire on 0.092" diameter fiberglass core. This heater assembly was then covered with 0.040" thick wall fiberglass sleeving. This unit will generate one hundred watts at 120 volts.

Figure 8:
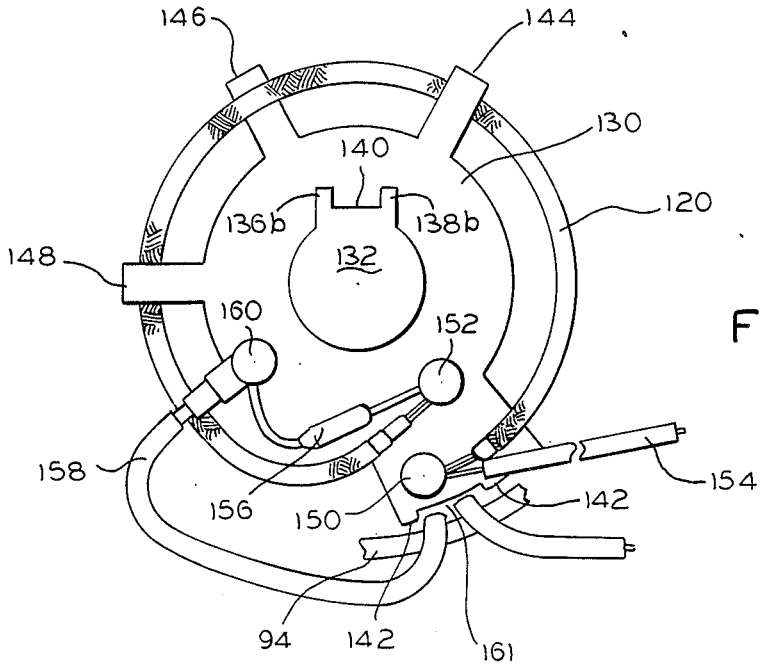
FIG. 8 is a plan view of a simple device for snapping over the top of the motor of FIG. 7 to heat air before going to the mat.

Thus, there is a need to provide a safe mounting device for the heater in an area which is protected from all water or moisture. As explained above, many safety features have already been built into the design of the air bubbling mat 20 and the air pump head 50 to prevent it from giving shock hazards. The safest place for the heater 120, in this protected environment is above the motor, as shown in FIG. 7. This elevated location does cause extra heat near the motor and, therefore, reduces somewhat the cooling effects of air stream 108. On the other hand, a motor which is capable of operating satisfactorily at a slightly elevated temperature is not very much more, if any, expensive than one which requires a lower operating temperature. Many, if not most, motors which are likely to be used for driving the air pump operate satisfactorily by a level of heat that may appear in the motor when augmented by heater 120. Therefore, the offsetting safety of a heater positioned above the motor is well worth any disadvantage presented by an increase of heat at this location.

To provide an extremely low cost heater, a die cut spider 130 (FIG. 8) is formed of insulating board (such as the material used to make printed circuit boards, for example). The spider 130 has a central hole 132 which fits snugly over a reduced diameter, such as an end bearing bracket or cap 134 (FIG. 7), found on most motors. This cap is integrally formed with two outstanding fins or ears 136*a*, 138*a*. Two complementary, spaced parallel slots 136*b*, 138*b* are formed in the insulating board to fit over ears 136*a*, 138*a* and prevent a rotation of spider 130. A somewhat cantilevered leaf spring tongue 140 is formed by slots 136*b*, 138*b* extending up to the periphery of the hole 132. As the hole 132 is pressed down over the motor bearing cap 134, tongue 140 fits between ears 136*a*, 138*a* and may deflect somewhat to take a bite on the motor bearing cap 134 and thus to help hold it in place. A suitable clamp ring (not shown) is added over cap 134 to secure the spider 130 in place.

A plurality of arms 142–148 extend radially and outwardly from the central section of the spider 130. The rope heater 120 weaves over and under these arms for vertical support. The ends of the rope heater 120 are attached to the spider 130 by any suitable terminals which, in turn, are secured by rivets 150, 152. Spade terminals are preferred. The neutral side 154 of the AC power line is attached to the spider 130 and the rope heater 120 by rivet 150. The opposite end of the rope heater 120 is attached to the spider 130 at rivet 152. A one-shot fuse 156 is also captured under rivet 152 and, therefore, connected to the rope heater. This fuse 156 burns out very fast if there is an overload, which would occur if the rope heater 120 becomes wet or if the air supply is cut-off, as when the motor stops. The distant end of fuse 156 and the wire 158 leading to the motor are connected to the spider 130 by a rivet 160. The motor wire 158 passes through a notch 161 formed by arms 142, 142 in the spider and is held in place within notch 161 by the wall 94 which surrounds the motor. Obviously the terminal and wire 158 should stand up far enough away from board 130 to pass over the rope heater 120 by a sufficient distance to avoid insulation damage to the wire 150 from the heat of the rope heater.

Those who are skilled in the art will readily perceive how to modify the invention. Therefore, the appended claims are to be construed to cover all equivalent structures which fall within the true scope and spirit of the invention.

The claimed invention is:

1. A portable air bubbling mat assembly for temporary installation in body of water, said assembly comprising a mat means having air discharge holes therein for bubbling air through said body of water, an air pump means, an air hose coupled between said air pump means and said mat means, an electric motor in said air pump for driving air through said hose and out said air holes, safety means for protecting a user against electrocution if said motor is at least partially exposed to water, rope heater means woven on a spider support in said air pump means and protected by said safety means, said heater means heating said air before said air is driven through said air holes, means for mounting said spider support on said electric motor at a location which is most remote from any water which is associated with said bath mat, wherein said motor has an end cap with integral fingers extending therefrom, said spider is an insulating board with a central hole which is dimensioned to fit over said end cap, and a spaced parallel pair of slots extending away from said hole to fit over said integral fingers to prevent rotation of said spider.

2. The assembly of claim 1 wherein said safety means comprises a duck bill valve located in the path of said driven air for permitting air to flow while preventing a back flow of water through said hose to said motor.

3. The assembly of claim 2 wherein said safety means further comprises a water collection compartment for collecting water if any which may back flow through said valve, said compartment being located at a point which is remote from said heater means.

4. The assembly of claim 1 wherein said heater means has an extremely low thermal inertia to give almost instant heat.

5. The assembly of claim 1 and a fast acting one-shot fuse coupled between said rope heater and a power source, said one-shot fuse permanently disconnecting said rope heater from said power source if said rope heater becomes wet or air flow is interrupted.

* * * * *